US009649541B2

(12) United States Patent
Soracco

(10) Patent No.: US 9,649,541 B2
(45) Date of Patent: May 16, 2017

(54) GOLF CLUB WITH MULTI-COMPONENT CONSTRUCTION

(71) Applicant: Cobra Golf Incorporated, Carlsbad, CA (US)

(72) Inventor: Peter L. Soracco, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 357 days.

(21) Appl. No.: 14/255,128

(22) Filed: Apr. 17, 2014

(65) Prior Publication Data

US 2014/0228148 A1 Aug. 14, 2014

Related U.S. Application Data

(63) Continuation of application No. 12/761,377, filed on Apr. 15, 2010, now Pat. No. 8,734,265.

(51) Int. Cl.

| | |
|---|---|
| ***A63B 53/04*** | (2015.01) |
| ***A63B 53/06*** | (2015.01) |
| *A63B 53/02* | (2015.01) |

(52) U.S. Cl.

CPC ..... *A63B 53/0466* (2013.01); *A63B 53/04* (2013.01); *A63B 53/06* (2013.01); *A63B 2053/026* (2013.01); *A63B 2053/045* (2013.01); *A63B 2053/0416* (2013.01); *A63B 2053/0433* (2013.01); *A63B 2053/0454* (2013.01); *A63B 2053/0462* (2013.01); *A63B 2053/0491* (2013.01)

(58) Field of Classification Search

USPC ..... 473/324–350

See application file for complete search history.

(56) References Cited

U.S. PATENT DOCUMENTS

| | | | |
|---|---|---|---|
| 1,531,821 | A | 3/1925 | Scott |
| 1,916,792 | A | 7/1933 | William |
| 2,026,749 | A | 1/1936 | Pester |
| 2,550,846 | A | 5/1951 | Milligan |
| 2,715,598 | A | 8/1955 | Rees et al. |
| 3,190,651 | A | 6/1965 | Thomas |
| D240,948 | S | 8/1976 | Redouty |
| 3,976,299 | A | 8/1976 | Lawrence et al. |
| D247,922 | S | 5/1978 | Sheldon |
| 4,194,739 | A | 3/1980 | Thompson |
| 4,431,192 | A | 2/1984 | Stuff, Jr. |
| 4,618,149 | A | 10/1986 | Maxel |

(Continued)

FOREIGN PATENT DOCUMENTS

| | | |
|---|---|---|
| EP | 0 659 452 A1 | 6/1995 |
| GB | 427521 A | 4/1935 |

(Continued)

OTHER PUBLICATIONS

Extended European Search Report dated Jul. 23, 2012, 13 pages.

*Primary Examiner* — Alvin Hunter

(74) *Attorney, Agent, or Firm* — Brown Rudnick LLP; Mark S. Leonardo

(57) ABSTRACT

A golf club head with multi-component construction. The golf club head includes heel and toe portions that generally provide ground contacting surfaces and a raised central region. A center of gravity of the club is located outside of an envelope defined by the outer surface of the club head below the raised central region.

4 Claims, 11 Drawing Sheets

(56) References Cited

U.S. PATENT DOCUMENTS

| | | | | |
|---|---|---|---|---|
| 4,828,265 | A | 5/1989 | Antonious | |
| 4,850,593 | A | 7/1989 | Nelson | |
| 4,930,783 | A | 6/1990 | Antonious | |
| 5,451,056 | A | 9/1995 | Manning | |
| 5,464,217 | A | 11/1995 | Shenoha et al. | |
| 5,467,988 | A | 11/1995 | Henwood | |
| 5,476,262 | A | 12/1995 | Bandiero | |
| 5,497,995 | A | 3/1996 | Swisshelm | |
| 5,516,106 | A | 5/1996 | Henwood | |
| 5,630,766 | A | 5/1997 | Granelli | |
| 5,643,107 | A | 7/1997 | Gorman | |
| 5,683,307 | A | 11/1997 | Rife | |
| D392,007 | S * | 3/1998 | Fox | D21/752 |
| D393,032 | S | 3/1998 | Stone et al. | |
| 5,735,754 | A | 4/1998 | Antonious | |
| D397,387 | S | 8/1998 | Allen | |
| D398,349 | S | 9/1998 | Butler | |
| 5,888,148 | A | 3/1999 | Allen | |
| 6,299,546 | B1 | 10/2001 | Wang | |
| 6,354,961 | B1 | 3/2002 | Allen | |
| 6,422,951 | B1 | 7/2002 | Burrows | |
| 6,663,503 | B1 | 12/2003 | Kenmi | |
| 7,335,112 | B1 | 2/2008 | Bitondo | |
| 7,585,233 | B2 * | 9/2009 | Horacek | A63B 53/0466 473/345 |
| 7,641,568 | B2 | 1/2010 | Hoffman et al. | |
| 7,753,809 | B2 | 7/2010 | Cackett et al. | |
| 7,828,676 | B2 | 11/2010 | Wada et al. | |
| 8,556,742 | B2 | 10/2013 | John | |
| 8,591,354 | B2 | 11/2013 | Yokota | |
| 8,628,433 | B2 | 1/2014 | Stites et al. | |
| 8,657,703 | B2 | 2/2014 | Wada et al. | |
| 8,678,948 | B2 | 3/2014 | Wada et al. | |
| 8,727,910 | B2 | 5/2014 | Nakano | |
| 8,747,251 | B2 | 6/2014 | Hayase et al. | |
| 8,764,579 | B2 | 7/2014 | Ban | |
| 8,771,097 | B2 | 7/2014 | Bennett et al. | |
| 8,858,363 | B2 | 10/2014 | Wada et al. | |
| 9,114,293 | B2 * | 8/2015 | Soracco | A63B 53/06 |
| 2002/0098903 | A1 | 7/2002 | Antler | |
| 2003/0045371 | A1 | 3/2003 | Wood et al. | |
| 2004/0029653 | A1 | 2/2004 | Whitehill et al. | |
| 2010/0009771 | A1 | 1/2010 | Newcomer | |
| 2011/0256954 | A1 | 10/2011 | Soracco | |
| 2013/0029780 | A1 | 1/2013 | Beno et al. | |
| 2013/0059678 | A1 | 3/2013 | Stites et al. | |
| 2013/0085013 | A1 | 4/2013 | Stites et al. | |
| 2013/0130834 | A1 | 5/2013 | Stites et al. | |

FOREIGN PATENT DOCUMENTS

| | | | |
|---|---|---|---|
| GB | 591595 | A | 8/1947 |
| JP | 04327865 | A | 11/1992 |
| JP | 06-142240 | | 5/1994 |
| JP | 07-204299 | | 8/1995 |
| JP | 10-33723 | | 2/1998 |
| JP | 10118229 | A | 5/1998 |
| JP | 10-151229 | | 6/1998 |
| JP | 2000-317018 | A | 11/2000 |
| JP | 2003-102877 | A | 4/2003 |
| JP | 2004237039 | A | 8/2004 |
| JP | 2005-230230 | A | 9/2005 |
| JP | 2006-075430 | A | 3/2006 |
| JP | 2006-116208 | A | 5/2006 |
| JP | 2012010926 | A | 1/2012 |

* cited by examiner

GOLF CLUB WITH MULTI-COMPONENT CONSTRUCTION

CROSS-REFERENCE TO RELATED APPLICATION

This application is a continuation of U.S. patent application Ser. No. 12/761,377 filed Apr. 15, 2010, the contents of which are incorporated by reference.

FIELD OF THE INVENTION

This invention generally relates to golf club heads, and more specifically to the construction of hollow golf club heads.

BACKGROUND OF THE INVENTION

Golf club heads come in many different forms and makes, such as wood- or metalwood-type (including drivers and fairway woods), iron-type (including wedge-type club heads), utility- or specialty-type, and putter-type club heads. Each of these types has a prescribed function and make-up. The present invention primarily relates to wood-type and utility-type golf club heads.

The design and manufacture of wood-type golf clubs requires careful attention to club head construction. Among the many factors that must be considered are material selection, material treatment, structural integrity, and overall geometric design. Exemplary geometric design considerations include loft, lie, face angle, horizontal face bulge, vertical face roll, face size, sole curvature, center of gravity, moment of inertia, and overall head weight. The interior design of the club head may be tailored to achieve particular characteristics, such as by including a hosel or other shaft attachment means, perimeter weighting on the face or body of the club head, and fillers within hollow club heads. Club heads typically are formed from stainless steel, aluminum, and/or titanium, and are cast, stamped as by forming sheet metal with pressure, forged, or formed by a combination of any two or more of these processes.

Some club heads are formed from multiple pieces that are welded, bonded or otherwise joined together to form a hollow head. The multi-piece constructions facilitate access to the cavity formed within the club head, thereby permitting the attachment of various other components to the head such as internal weights and the club shaft. The cavity may remain empty, or may be partially or completely filled, such as with foam. An adhesive may be injected into the club head to provide the correct swing weight and to collect and retain any debris that may be in the club head. In addition, due to difficulties in manufacturing one-piece club heads to high dimensional tolerances, the use of multi-piece constructions allows the manufacture of a club head to a tight set of standards.

With golfers constantly searching for golf clubs that provide greater distance and accuracy, the golf industry has responded by providing a wide array of golf clubs with vastly differing physical attributes. However, historically, the head sizes of wood-type golf clubs have generally increased, which has allowed improved mass manipulation. The manipulation of mass allows the designer to alter attributes, such as the moment of inertia and the location of the center of gravity to provide a more forgiving golf club. In particular, providing a higher moment of inertia increases the ability of the golf club head to resist twisting on imperfect golf ball impacts. Additionally, the size of the golf club head allows more discretion in locating the center of gravity.

It is desirable to provide a golf club that provides for increased discretionary mass while providing desired performance attributes.

SUMMARY OF THE INVENTION

The invention is directed to a golf club head with multi-component structure that provides desired performance characteristics.

In an embodiment, a golf club head includes a crown body, a heel body, a toe body and a face body. The crown body includes a heel portion and a toe portion. The heel body extends downward from the heel portion of the crown and the toe body extends downward from the toe portion of the crown. The face body includes a ball striking surface, and extends forward from the crown body, the heel body and the toe body. The heel body, the toe body, and the face body combine to define a central cavity that is openly exposed downward. A center of gravity of the golf club head is disposed within the central cavity between the heel body and the toe body, and an axis of percussion does not intersect a raised central portion of a sole surface of the club head.

In another embodiment, a golf club head includes a crown body, a heel body, a toe body, and a face body. The crown body includes a heel portion and a toe portion. The heel body extends downward from the heel portion of the crown and the toe body extends downward from the toe portion of the crown. The face body includes a ball striking surface and extends forward from the crown body, the heel body and the toe body. The heel body, the toe body, and the face body combine to define a central cavity that is openly exposed downward and at least one of the heel body and the toe body has a portion having a maximum lateral dimension in a heel to toe direction that is spaced from the face body.

In a further embodiment, a golf club head includes a crown body, a heel body, a toe body, a face body, a hinge and a hinge locking mechanism. The crown body includes a heel portion and a toe portion. The heel body extends downward from the heel portion of the crown and the toe body extends downward from the toe portion of the crown. The face body including a ball striking surface. The hinge couples the face body to a second body member that is one of the crown body, the heel body and the toe body. The hinge locking mechanism is configured to retain the face body in a predetermined angular orientation relative to the second body member.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

Figure 1:
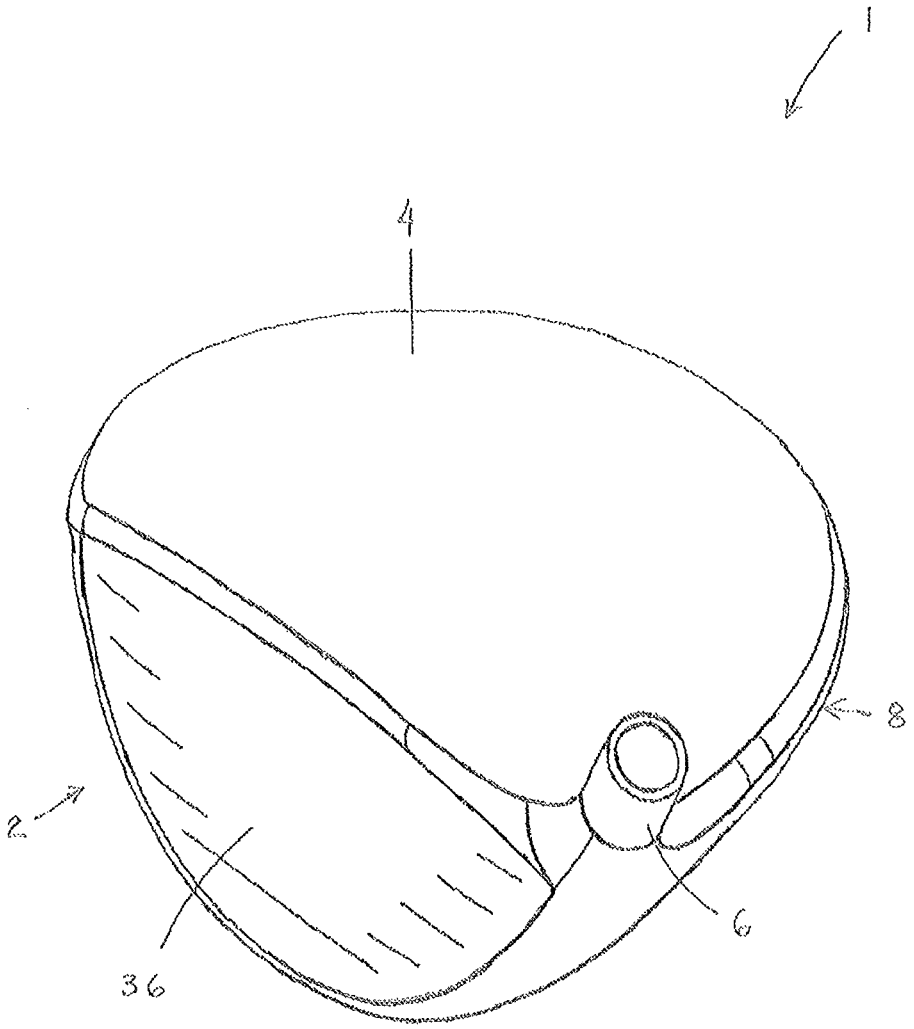
FIG. 1 is a perspective view of a golf club head of the present invention.

The present invention is directed to a golf club head including a multi-component structure. Several embodiments of the present invention are described below.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Referring first to FIGS. 1-6, a golf club head including a construction of the present invention will be described. Golf club head 1 generally includes a face body member 2 that includes a forward ball-striking surface, a crown 4, a hosel 6, a heel body member 8 and a toe body member 10. Rather than having a sole surface that generally matches the plan area of the crown, club head 1 includes an unconventional construction by including a raised central body portion of the golf club head and elongate lateral sole portions, or pontoons, formed by heel body member 8 and toe body member 10 that combine to define a central cavity on the underside of the club head that is opened downward.

Figure 2:
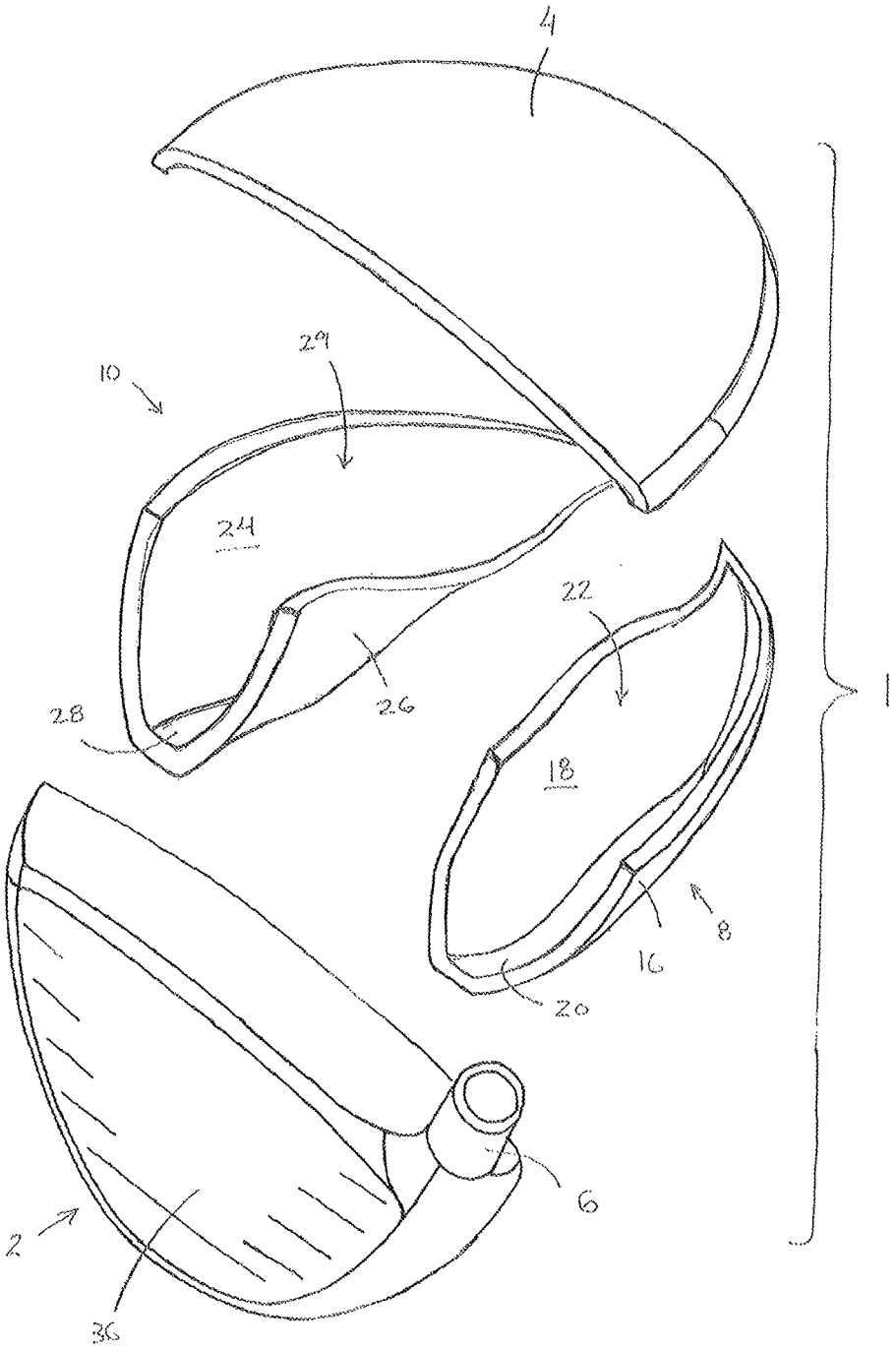
FIG. 2 is an exploded view of the golf club head of FIG. 1.
Figure 3:
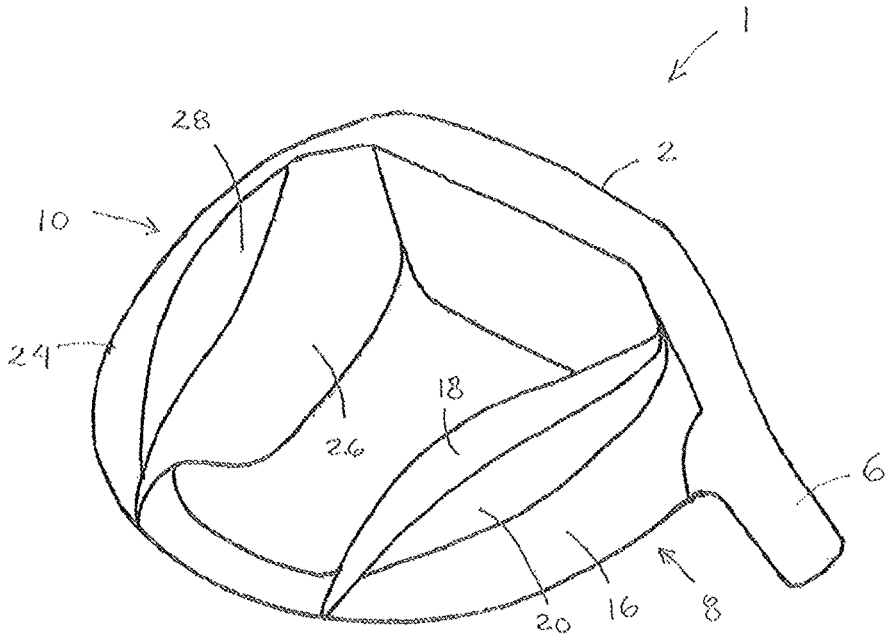
FIG. 3 is a bottom perspective view of the golf club head of FIG. 1.
Figure 4:
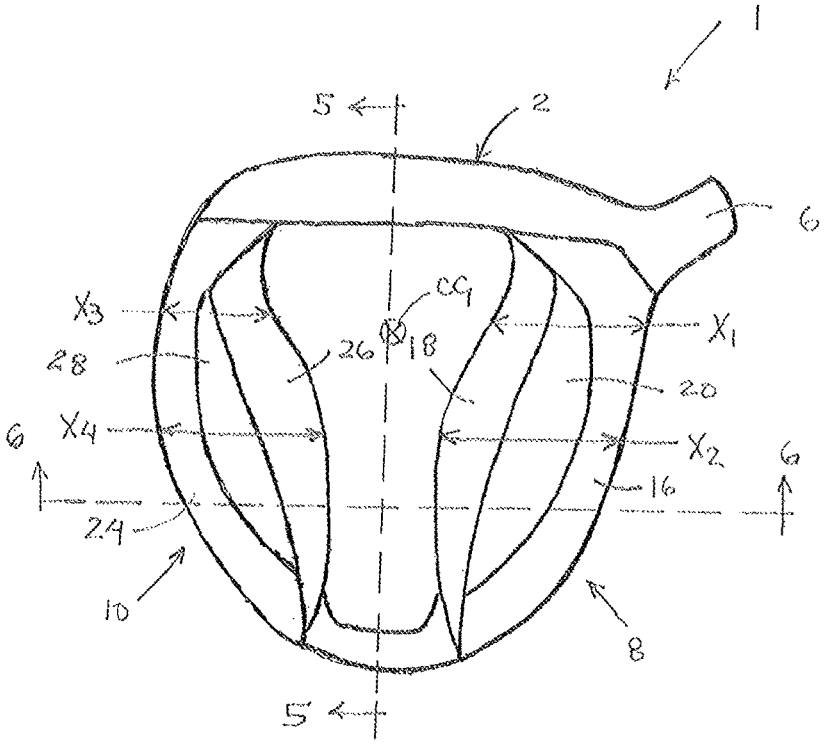
FIG. 4 is a bottom view of the golf club head of FIG. 1.

In the present embodiment, heel body member 8 and toe body member 10 are separate shell members that are coupled to crown 4 and face member 2, as shown in FIG. 2. Heel body member 8 extends rearward from face member 2 on a heel side of the golf club head. An outer wall 16 of heel body member 8 is coupled to crown 4 along a heel portion of the perimeter of crown 4. Outer wall 16 extends downward from crown 4 and joins with an inner wall 18 and a sole wall 20. Inner wall 18 extends upward from sole wall 20 and is coupled to crown 4 at a location spaced inward from the perimeter of crown 4. Heel body member 8 combines with face member 2 and crown 4 to define a heel cavity 22. Preferably, the heel cavity forms about 10% to about 30% of the total enclosed volume of golf club head 1 and heel body member 8 is coupled to crown 4 over about 10% to about 35% of the periphery of crown 4.

Heel body member 8 has a lateral outer dimension that changes over its length. For example, the maximum outer dimension is located at an intermediate location along heel body portion 12, indicated by dimension $X_2$ of FIG. 4. Preferably, the lateral dimension tapers to a point at an aft end of heel body portion 12 and to a predetermined dimension $X_1$ that is less than dimension $X_2$ at a forward end of heel body member 8 adjacent face member 2. Furthermore, in the present embodiment, heel body member 8 is generally tapered from crown 4 to sole wall 20 so that it narrows from the crown toward the sole wall, but it should be appreciated that the heel body member may alternatively be tapered so that it widens from the crown toward the sole wall to further concentrate mass lower in the golf club head.

Toe body member 10 also extends rearward from face member 2. Toe body member 10, however is disposed on a toe side of the golf club head. Toe body member 10 includes an outer wall 24 and an inner wall 26 that combine with a toe ward sole wall 28 and a portion of crown 4 to define a hollow toe cavity 29. The hollow body forms about 10% to about 30% of the total enclosed volume of golf club head 1 and toe body member 10 is coupled to crown 4 over about 10% to about 35% of the periphery of crown 4.

Toe body member 10 has a lateral outer dimension that changes over its length, similar to the heel body member. For example, the maximum outer dimension $X_4$ is located at an intermediate location along toe body member 10 from a reduced dimension $X_3$ adjacent face member 2. Additionally, toe body member 10 is tapered so that it narrows from crown 4 to sole wall 28. It should be appreciated that the toe body member may alternatively be tapered so that it widens from the crown toward the sole wall to further concentrate mass lower in the golf club head. Each of the heel and toe body members has a reduced dimension adjacent the face member so that the impact on the flexibility of the face member is reduced. In particular, the face member is preferably flexible so that a desired coefficient of restitution may be achieved. The dimension is reduced so that the heel and toe members do not unduly increase the rigidity of the face.

Figure 5:
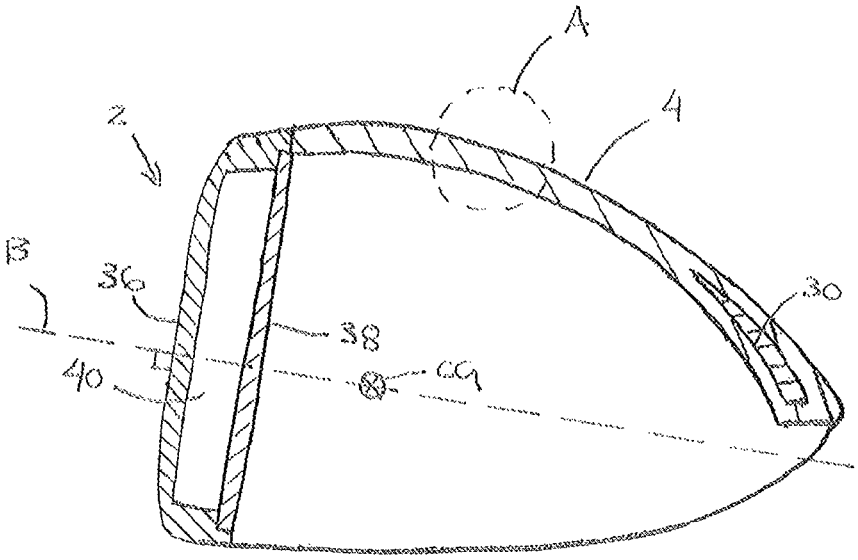
FIG. 5 is a cross-sectional view of the golf club head of FIG. 1, taken along line 5-5 shown in FIG. 4.
Figure 6:
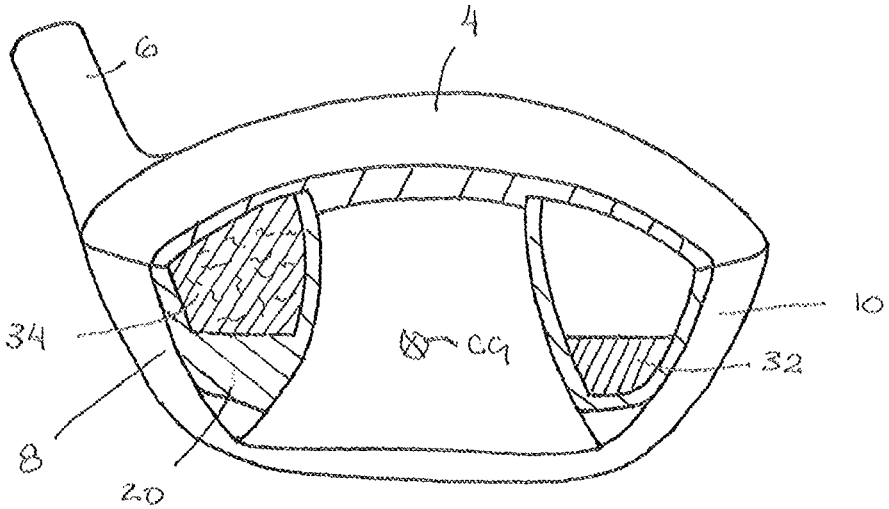
FIG. 6 is a cross-sectional view of the golf club head of FIG. 1, taken along line 6-6 shown in FIG. 4.

In the present embodiment, crown 4 forms the raised central body portion 13 and extends between heel body member 8 and toe body member 10 to rigidly couple the body portions. From above, crown 4 includes a continuous bulbous top surface so that when golf club head 1 is placed in an address position by a golfer it provides the appearance of a conventional golf club head. Crown 4, as shown in FIGS. 5 and 6, is constructed in a first configuration in which crown 4 includes a thickness and is constructed from a selected material to provide the desired structural rigidity.

Additionally, a lower surface of crown 4 also forms the lower surface of the raised central body portion 13. Because of that construction, a center of gravity of golf club head 1 is located within the central cavity, below central portion 13, and outside of an envelope defined by the outer surfaces of club head 1. In particular, the center of gravity is located below the lower surface of crown 4 and between heel body member 8 and toe body member. Preferably, an axis of percussion B, i.e., an axis extending from the ball-striking face orthogonally and through the center of gravity, does not intersect a sole surface of the club head. As used herein, "sole surface" refers to the lowermost downward facing surface of the club head, which may be the lower surface of a crown member or a lower surface of a sole member depending on the particular construction. As a result a central portion of the sole surface is substantially above a center of percussion of the golf club head. As a result, the rigidity of the face is not increased significantly by the central portion.

The structure of golf club head 1 provides ground contacting surfaces on both of heel body member 8 and toe body member 10 and concentrates the mass of the club head toward the heel and toe. As a result, the stability of the club head during address is increased and the moment of inertia of the club head may be more easily manipulated while the face may remain flexible to optimize the coefficient of restitution.

Crown 4 may have a multi-material structure. For example, crown 4 may include one or more weight members 30. Weight members 30 may be located in any portion of crown 4 and may be embedded or attached thereto. For example, weight members 30 may be co-molded or cast into crown 4 or they may coupled to an inner or an outer surface of crown 4. In the illustrated embodiment, weight member 30 is disposed in a rear central portion of crown 4, but it should be appreciated that weight members 30 may be included in heel ward and/or toe ward locations to impart any desired draw or fade biased ball flight or to locate the center of gravity or to achieve a desired moment of inertia to impart a desired forgiveness to the golf club head.

Any material may be used to construct the face member, the crown, the toe body member and the heel body member, such as any metallic or non-metallic material. For example, the components may be constructed from titanium, steel, magnesium, aluminum, carbon fiber, abs plastic, and alloys thereof. Additionally, in a club head the components may be constructed from different materials to provide a desired mass distribution. The components may be cast, injection molded, forged, stamped, hydro-formed, direct sintered, and/or machined.

Additional body weight members 32 may be incorporated into one or both of heel body member 8 and toe body member 10. Body weight members 32 are generally constructed froth a material different than the material of the body members that has a higher specific weight than the body member material. Alternatively, the wall thicknesses of the body members may be altered to provide a desired mass distribution. For example, in the present embodiment, sole wall 20 of heel body member 8 has a thickness that is significantly greater than either of outer wall 16 or inner wall 18. Any portion of heel cavity 22 and/or toe cavity 29 remaining in the heel and/or toe body members after the inclusion of weighting materials may be filled with a filler material 34, such as foam, that preferably has a lower specific weight than the materials of the body and any weights.

The face member may also have many different configurations. In the present embodiment, face member 2 is constructed from a ball-striking member 36 that is coupled to a rear face member 38 and hosel 6. Ball-striking member 36 and back plate 38 combine to define a face cavity 40. Ball-striking member 36 may have a constant thickness or it may have varying thickness to provide any desired coefficient of restitution.

Figure 7:
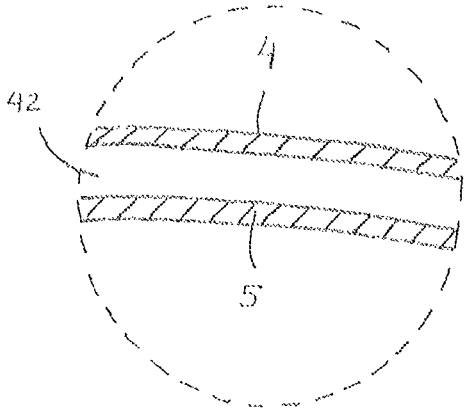
FIG. 7 is a cross-sectional view of an alternative construction of a portion of a golf club head, corresponding to detail A of FIG. 5.
Figure 8:
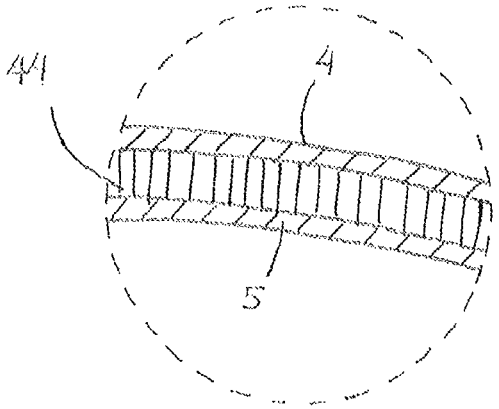
FIG. 8 is a cross-sectional view of another alternative construction of a portion of a golf club head, corresponding to detail A of FIG. 5.
Figure 9:
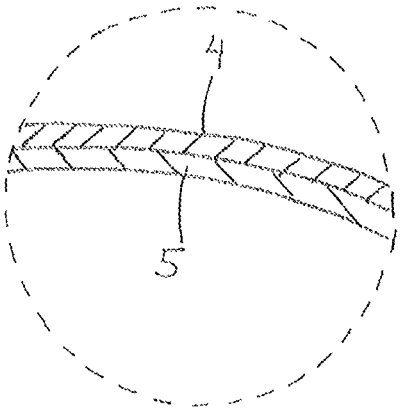
FIG. 9 is a cross-sectional view of another alternative construction of a portion of a golf club head, corresponding to detail A of FIG. 5.

Various alternatives are available to construct the golf club head. In particular, although the embodiment shown in FIGS. 1-6 does not include a separate sole body member, various alternative constructions are available, as illustrated in detail in FIGS. 7-9, that include both a crown 4 and a sole 5. FIG. 7 illustrates an embodiment that includes crown 4 spaced from sole 5 by a crown cavity 42. Preferably, crown 4 is spaced from sole by no more than 1.0 cm. Alternatively, the crown cavity 42 may include a filler 44, such as a cellular honeycomb material, foam or any other lightweight material that separates crown 4 from sole 5, as shown in FIG. 8. As a further alternative, crown 4 and sole 5 may be separate components that are directly attached to each other so that there is no cavity or filler, as shown in FIG. 9. It should be appreciated that the crown and the sole need not be the same material. Preferably, the crown or combination of crown and sole is selected that provides desired rigidity between the heel portion, the toe portion and the face while minimizing mass so that the mass may be concentrated in the heel portion and the toe portion.

Figure 10:
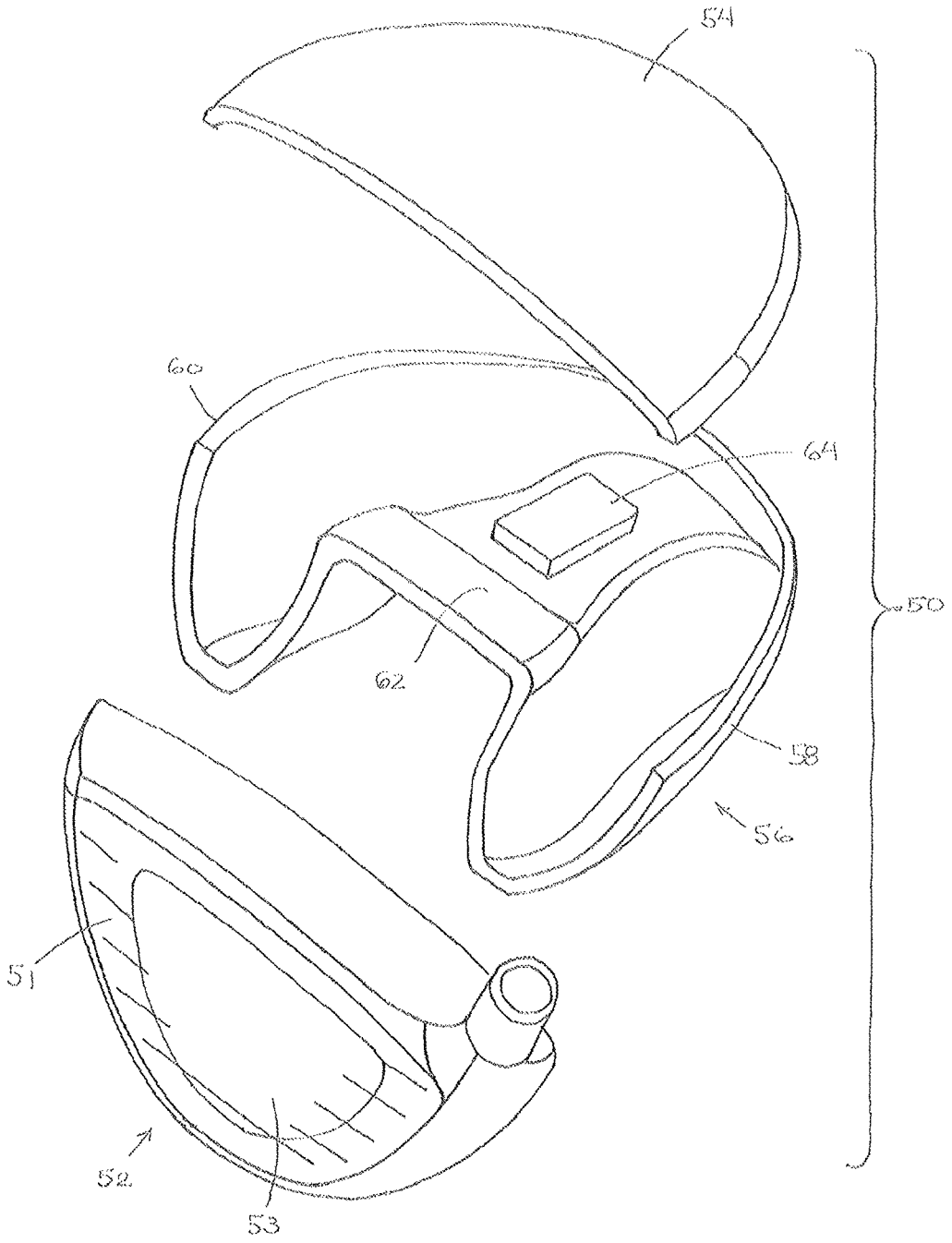
FIG. 10 is an exploded view of another embodiment of a golf club head in accordance with the present invention.

Referring now to FIG. 10, golf club head 50 will be described. Golf club head 50 includes a face member 52, crown member 54 and sole member 56. Rather than having separate heel and toe body members, golf club head 50 includes a single sole member that includes a heel body portion 58, a toe body portion 60 and a raised central portion 62. Sole member 56 includes an opened upper portion that is closed by crown member 54 and an opened forward portion that is closed by face member 52 in the complete golf club head 50.

Face member 52 may be constructed as a single homogenous component, or it may be constructed from multiple components. For example, face member 52 may be a single component generally constructed as a face-cup, such as by forging, stamping or casting. In an alternate construction, face member 52 may include a face perimeter member 51 and a face insert 53 that is coupled to the face perimeter member. Face member 52 also includes a hosel 55 that is configured to receive a tip portion of a shaft in a completed golf club that incorporates club head 50.

Crown 54 extends across sole member 56 and is coupled to sole member 56 about at least a portion of its periphery. Crown 54 may also be coupled to sole member 56 at central portion 62. An insert 64 may also be included between crown 54 and central portion 62 so that portions of the inner surfaces of those bodies may be coupled in a spaced relationship to each other. From above, crown 54 includes a continuous bulbous top surface so that when golf club head 50 is at address it provides the appearance of a conventional golf club head.

Figure 11:
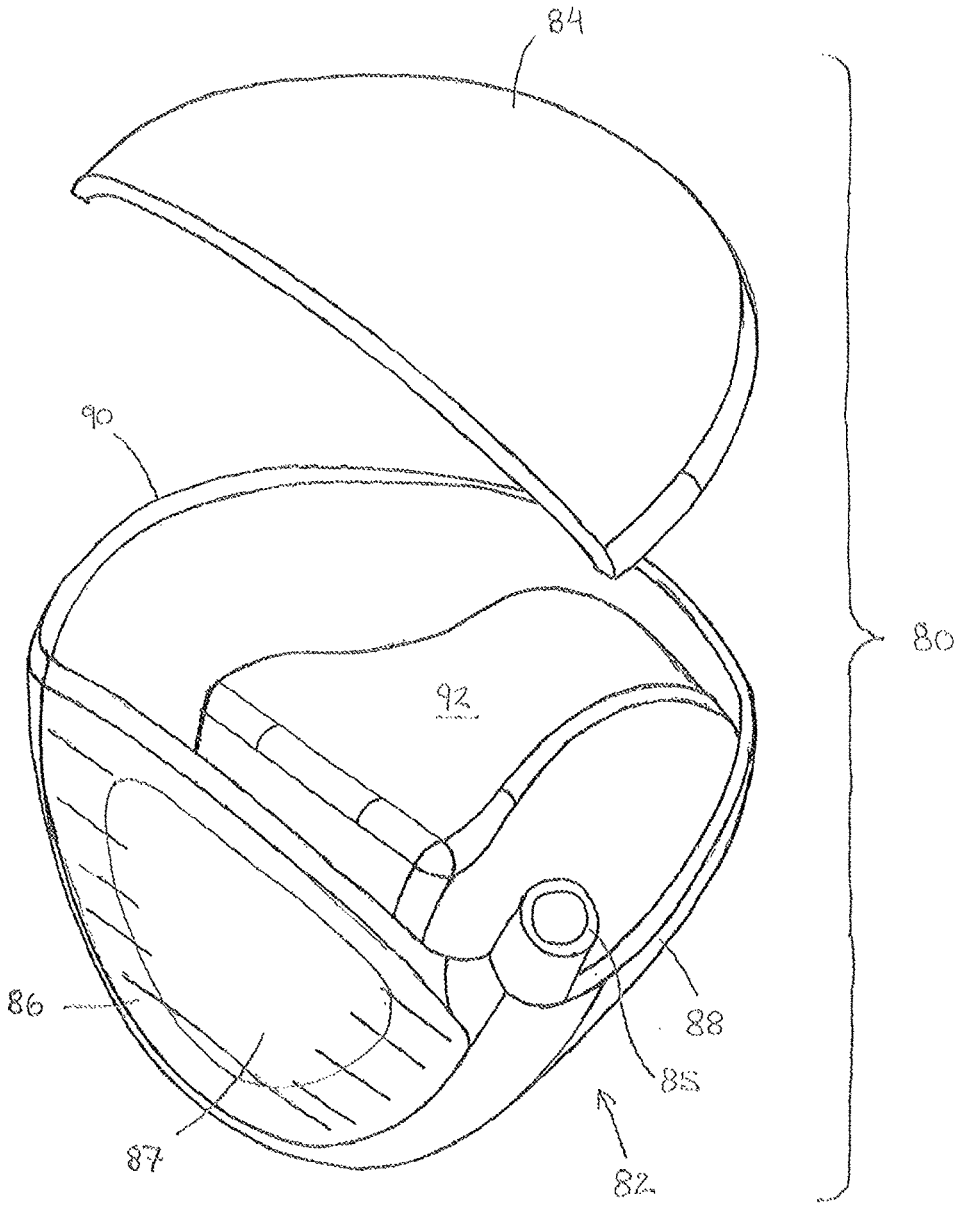
FIG. 11 is an exploded view of another embodiment of a golf club head in accordance with the present invention.

In another embodiment, shown in FIG. 11, a golf club head 80 includes a lower body member 82 and a crown 84. In this alternative construction, lower body member 82 includes a hosel 85, a face portion 86, a heel body portion 88, a toe body portion 90 and a raised central portion 92. Preferably, lower body member 82 is formed as a single homogeneous component, such as by casting all of the portions in a single operation. Lower body member 82 may also include integral weight members that are co-molded therewith or inserted and attached in a cavity. Lower body member 82 includes an opened upper portion that is closed by crown member 84. Face portion 86 may also include a face insert if desired. For example, lower body member 82 may be cast with a recess or aperture included in face portion 86 that receives a forged, stamped, or machined face insert 87 that is welded to face portion 86.

Crown 84 has a construction similar to those discussed previously and extends across lower body member 82 and is coupled to the lower body member about at least a portion of its periphery. Crown 84 may also be coupled to lower body member 82 at central portion 92 if desired.

Figure 12:
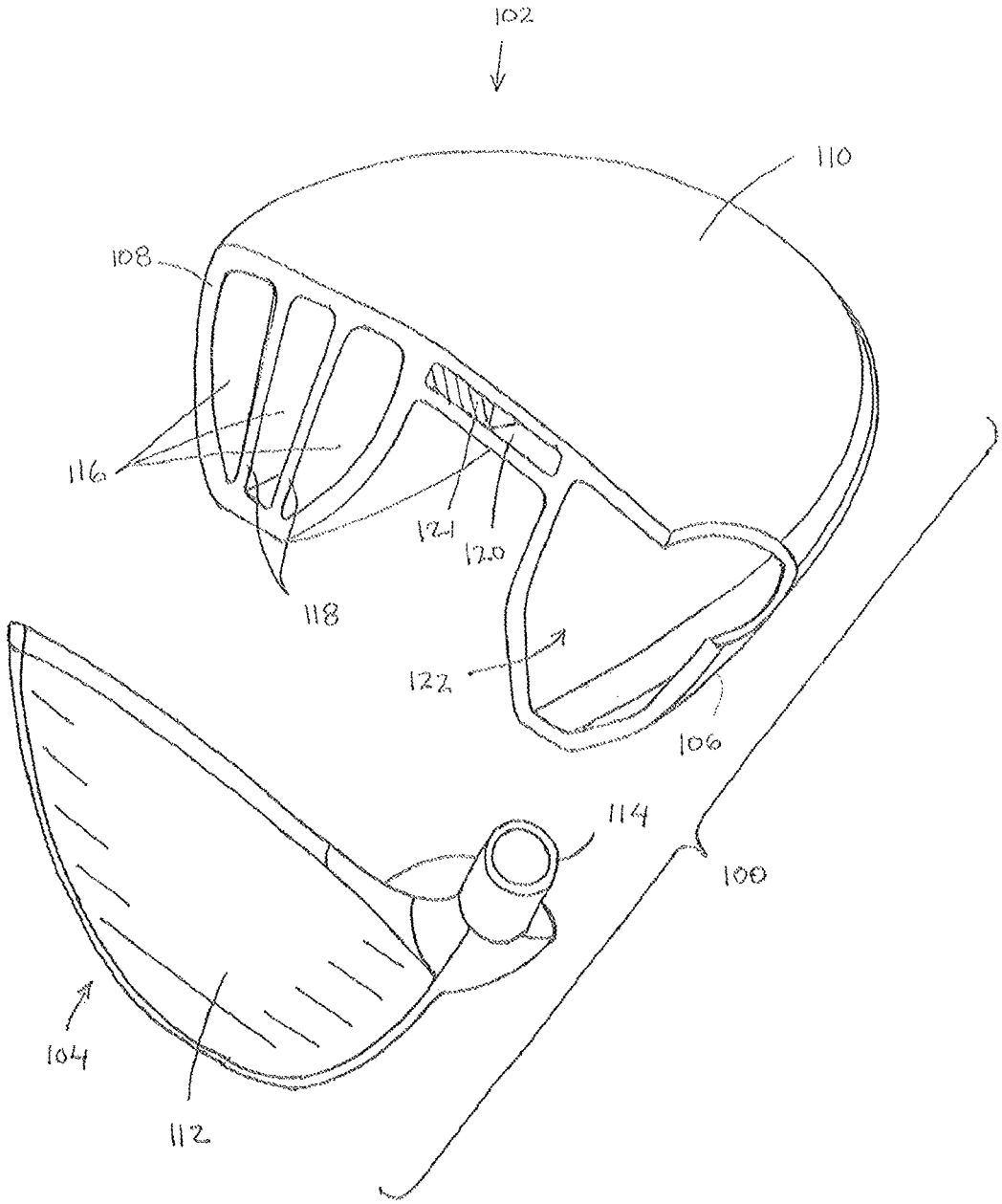
FIG. 12 is an exploded view of another embodiment of a golf club head in accordance with the present invention.
Figure 13:
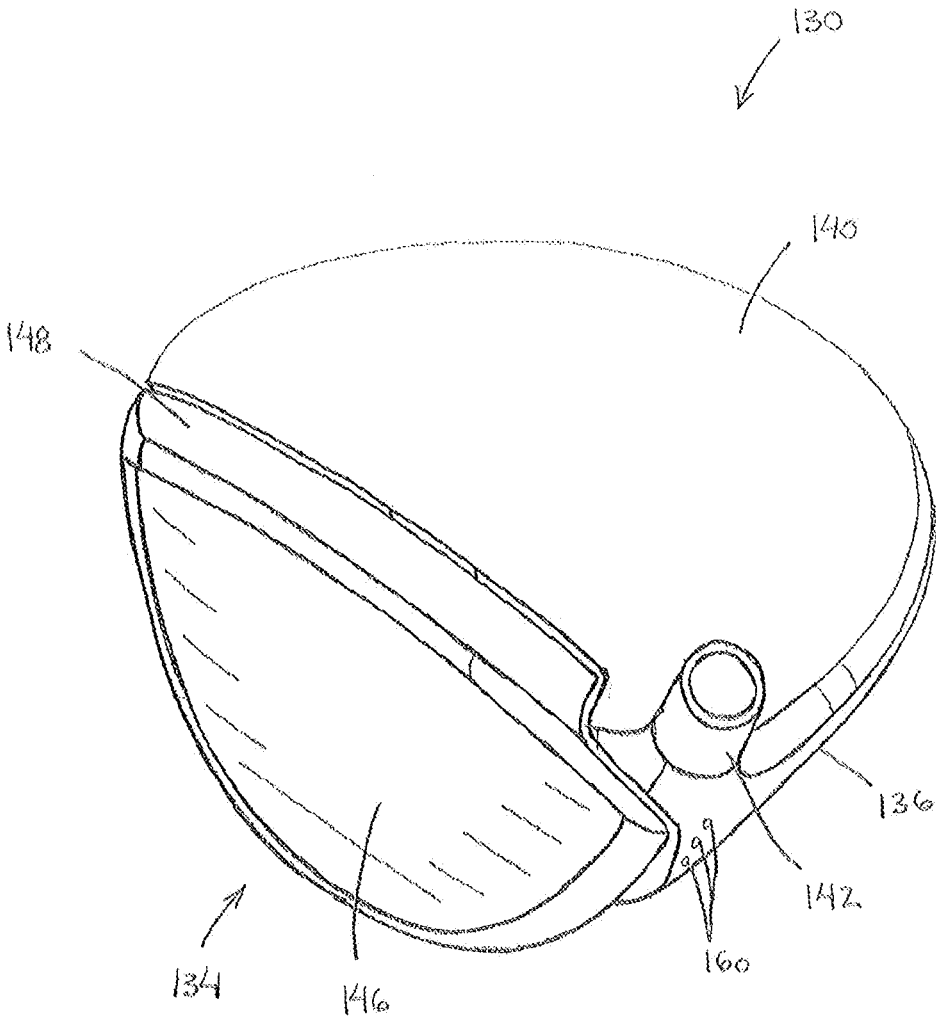
FIG. 13 is a perspective view of another embodiment of a golf club head of the present invention.
Figure 14:
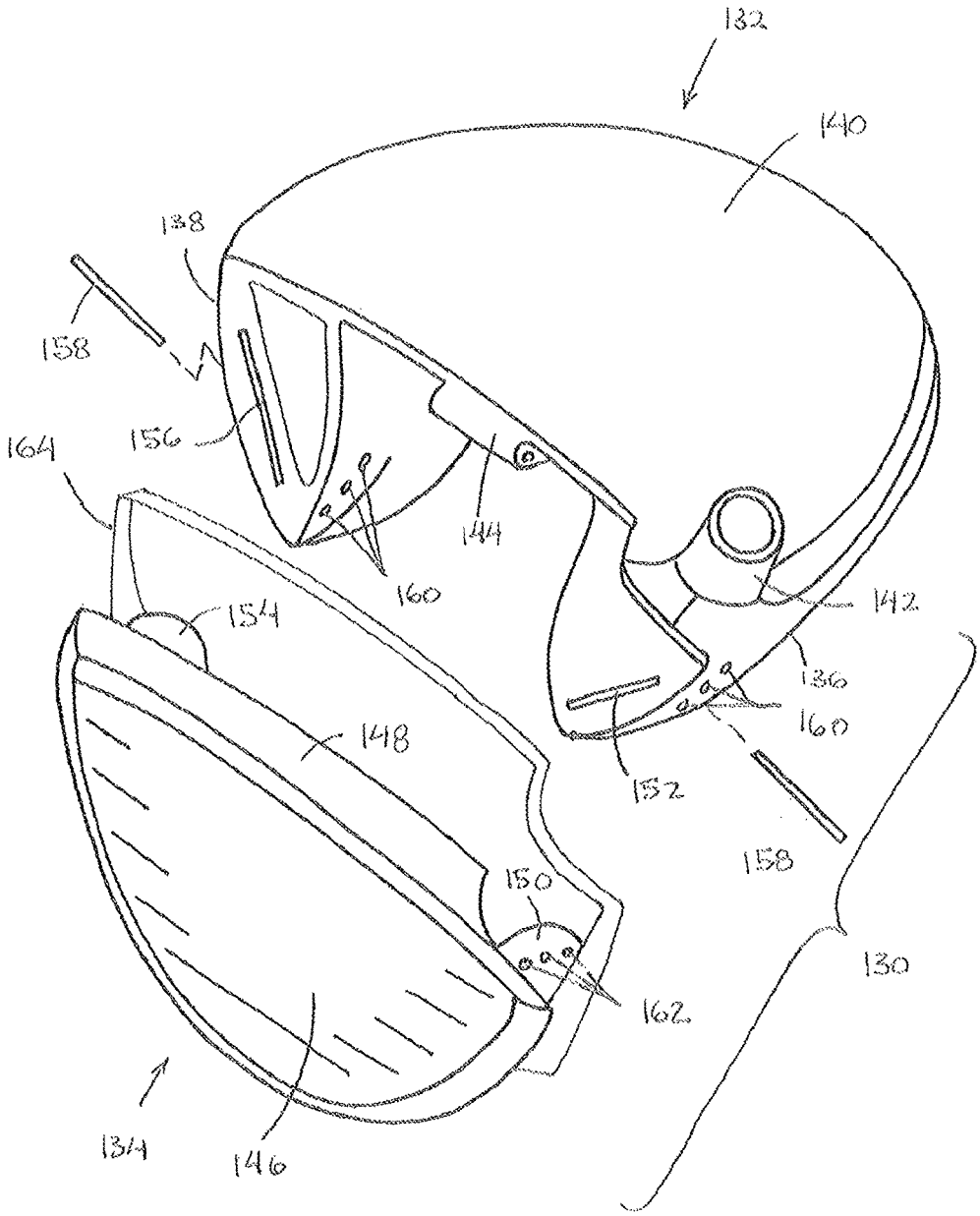
FIG. 14 is an exploded view of the golf club head of FIG. 13.
Figure 15:
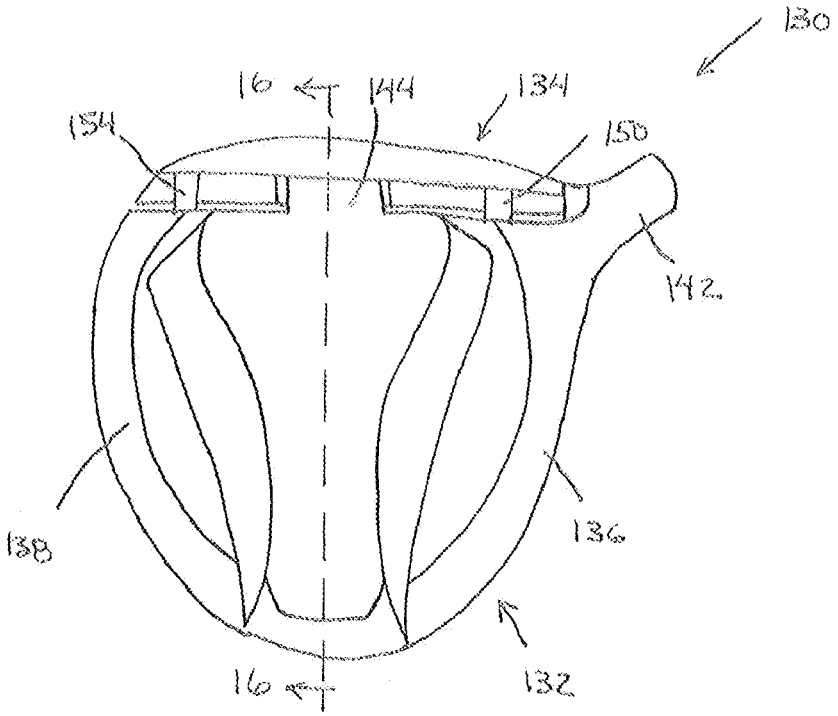
FIG. 15 is a bottom view of the golf club head of FIG. 1.
Figure 16:
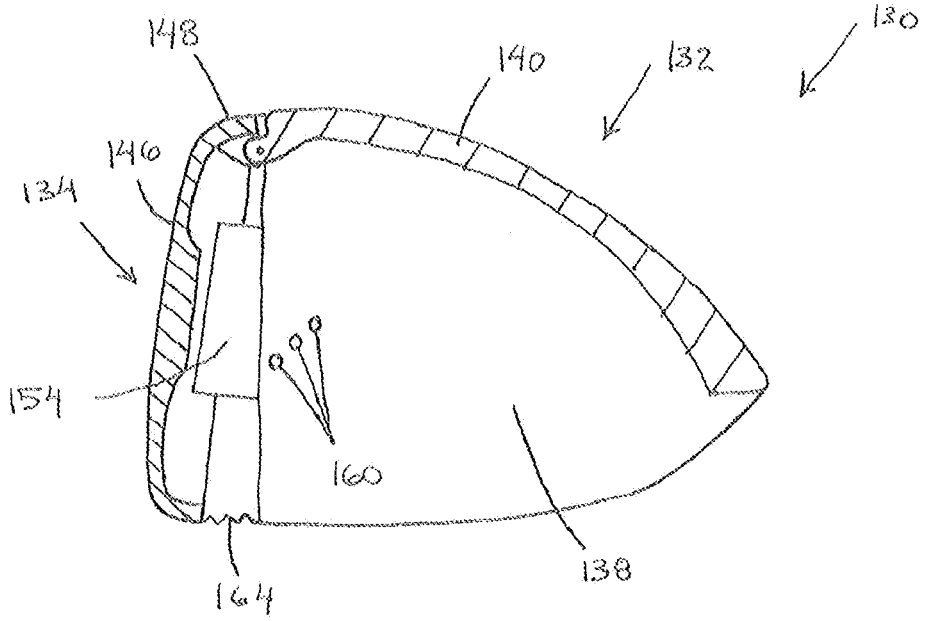
FIG. 16 is a cross-sectional view of the golf club of FIG. 13, taken along line 16-16 shown in FIG. 15.

Referring to FIG. 12, in another embodiment, a golf club head 100 is constructed from a rear body member 102 and a face member 104. Body member 102 includes a heel body portion 106, a toe body portion 108 and a crown 110 and is generally opened toward face member 104. Face member 104 generally includes a face plate 112 and a hosel 114 and is coupled to a forward end of body member 102.

Body member 102 defines a plurality of cavities that are generally opened forward and enclosed by the attachment of face member 104, or filled. Toe body portion 108 defines a plurality of toe cavities 116 that are separated by internal ribs 118. Although club head 100 includes three toe cavities 116, any number may be provided. Additionally, the configuration and number of ribs 118 is selected to provide desired rigidity to toe body portion 108. Moreover, a filler or inserts may be included in one or more of cavities 116. In a central region of body member 102, between the toe and heel body portions, a central cavity 120 is defined, which may be fully or partially filled if desired, such as by insert 121. Finally, heel body portion 106 defines a single heel cavity 122 that may also be fully or partially filled. It should be appreciated that the filler and/or inserts disposed in any of the cavities preferably are constructed from materials that have a specific weight that is different than the material of the remainder of body. For example, lightweight materials are generally used to alter the acoustics and/or rigidity of a portion of the golf club head and heavy materials may be used to alter the acoustics, the rigidity and/or mass distribution of the golf club head. It should be appreciated that the different portions of the golf club head may include any number of cavities.

A golfer that is in search of equipment that optimizes their performance often desires to alter various attributes of the golf club, including loft angle, face angle and lie angle. Generally, when a golfer desires to alter the loft angle of a golf club it is generally common practice to bend the hosel until the golf club head provides the desired loft angle. However, because of the conventional orientation of the hosel and the construction of the sole of a conventional golf club head, the loft angle, the lie angle and the face angle of the club head are coupled. As a result, when the hosel is bent to alter the loft angle, the lie angle and face angle may also be changed.

Referring to FIGS. 13-16, another embodiment of a golf club head according to the present invention will be described. In particular, golf club head 130 provides a structure that provides loft angle adjustment while the orientation of the shaft relative to a ground plane remains constant so that the lie angle and face angle generally remain unchanged.

Golf club head 130 generally includes a rear body member 132 and a face member 134. Body member 132 includes a heel body portion 136, a toe body portion 138, a crown 140, and a hosel 142. Body member 132 has a structure that is generally identical to the body member previously described, with regard to FIG. 12, with the addition of a hosel. Face member 134 is generally constructed as a face-cup and defines a ball-striking surface 146 and a face perimeter 148 that generally surrounds the ball-striking surface. Face member 134 may include generally constant face thickness or variable thickness, as shown.

Face member 134 is coupled to body member 132 so that they may be rotated relative to each other. In particular, the relative rotation is effectuated by a hinge 144 that couples body member 132 and face member 134. Hinge 144 includes mating portions on an underside of crown 140 and on face perimeter that engage each other and allow relative rotation between body member 132 and face member 134 about an axis that generally extends in a heel to toe direction. Alternatively, the hinge may be oriented to provide relative rotation between the body member and the face member along an axis that extends vertically so that the face angle may be adjusted independent of loft angle and lie angle. Still further, a plurality of hinges may be provided, for example one oriented to rotate about a heel to toe axis and another oriented to rotate about a vertical axis to provide adjustment of both loft angle and face angle.

Golf club head 130 also includes a hinge locking mechanism that retains body member 132 and face member 134 in a particular relative orientation. Preferably, the locking mechanism is configured to retain the components so that golf club head 130 is configured to have a plurality of predetermined lofts. For example, the locking mechanism may be constructed so that the golf club head can be configured with a loft angle of 8.5°, 9.5°, or 10.5°. The incremental change may be selected to be a constant change, such as 1° between each position, or the change may vary between positions. Preferably, the amount of each incremental angular change is between about 0.1° and about 1°. It should be appreciated that any number of positions may be provided.

In the present embodiment, the locking mechanism includes tabs attached to face member 134 that are received in cavities of body member 132 and anchored in place by pins 158. In particular, a heel tab 150 extends from a heel end of face member 134, rearward toward body member 132, and is slidably received in a heel cavity 152 of body member 132. Similarly, a toe tab 154 extends from a toe end of face member 134, rearward toward body member 132, and is slidably received in a toe cavity 156.

Body apertures 160 extend through portions of body member 132 and intersect heel cavity 152 and toe cavity 156. When the face member is in one of the predetermined orientations, corresponding tab apertures 162 align with body apertures 160 so that pins 158 may be inserted. When inserted, each pin extends across the sliding interface between the tab and cavity so that relative motion is prevented.

An optional gasket 164 may be provided to conceal or fill the gap created by the hinged interface between body member 132 and face member 134. Gasket 164 may also be configured to act as a dampener to reduce any "slop" presented by the hinged interface. Preferably, gasket is constructed from any flexible, rubber-like material.

While it is apparent that the illustrative embodiments of the invention disclosed herein fulfill the objectives stated above, it is appreciated that numerous modifications and other embodiments may be devised by those skilled in the art. Elements from one embodiment can be incorporated into other embodiments. Therefore, it will be understood that the appended claims are intended to cover all such modifications and embodiments, which would come within the spirit and scope of the present invention.

I claim:

1. A hollow, wood-type golf club head comprising:

a hollow body having a ball-striking face;

a crown extending aft from the face;

a hosel extending upwards from a heel side of the body when the club head is at address;

a sole extending back from the face beneath the crown; and a single cavity in the sole open downward and to the aft of the body when the club head is at address, the cavity having surfaces defined by a toe portion of the body, a heel portion of the body, and a surface underneath the crown; and at least one rib disposed on an interior of the club head, wherein the single cavity is wider, in a heel to toe direction, near the crown than near the sole.

2. The golf club head of claim 1, wherein the hollow body has a variable wall thickness.

3. A golf club head comprising:

a toe body, a heel body, a hosel disposed on the heel body, a face, a crown, a sole, a rear edge positioned opposite the face, and a single central cavity beginning rearward of the face and extending away from the face to the rear edge when the club head is at address, wherein said single central cavity is defined on a first side by a heel body, on a second side by the toe body, on a third side by the crown, and is open in a downward direction away from the crown when the club head is at address, wherein the single central cavity is wider, in a heel to toe direction, near the crown than near the sole.

4. A hollow, wood-type golf club head comprising:

a hollow body having a ball-striking face;

a crown extending aft from the face;

a hosel extending upwards from a heel side of the body when the club head is at address;

a sole extending back from the face beneath the crown;

a single cavity in the sole open downward and to the aft of the body when the club head is at address, the cavity having surfaces defined by a toe portion of the body, a heel portion of the body, and a surface underneath the crown; and at least one rib disposed on an interior of the club head, wherein the single cavity is widest, in a heel to toe direction, at an intermediate point between the face and the rear edge.

* * * * *